United States Patent [19]

Gardner et al.

[11] Patent Number: 5,031,541

[45] Date of Patent: Jul. 16, 1991

[54] STRATIFIED PROPELLANT CHARGE BARRIERS FOR SMALL AND MEDIUM CALIBER AMMUNITION

[75] Inventors: Robert J. Gardner, Bethalto, Ill.; David E. Merrill, Mesa, Ariz.

[73] Assignee: Olin Corporation, Cheshire, Conn.

[21] Appl. No.: 552,714

[22] Filed: Jul. 16, 1990

[51] Int. Cl.[5] ..... F42B 5/16

[52] U.S. Cl. ..... 102/443; 102/430

[58] Field of Search ..... 102/430, 431, 443, 478

[56] References Cited

U.S. PATENT DOCUMENTS

| | | | |
|---|---|---|---|
| 34,615 | 3/1862 | Shannon | 102/443 |
| 751,519 | 2/1904 | Kilzer | 102/443 |
| 1,920,075 | 12/1932 | Haenichen . | |
| 2,072,671 | 10/1934 | Foulke . | |
| 4,593,622 | 6/1986 | Fibranz . | |

FOREIGN PATENT DOCUMENTS

| | | | |
|---|---|---|---|
| 2059571 | 6/1972 | Fed. Rep. of Germany | 102/443 |

OTHER PUBLICATIONS

Abstracts for British Patents for Inventions, Abridgments of Specifications, Class 9, reprinted by Museum Restoration Service, Bloomfield, Canada 1981—British Patent No. 708 (1865); 409 (1871); 2,283 (1871); 14,915 (1884); 14,549 (1885); 16,874 (1886); 16,065 (1887); 16,879 (1888); 1,708 (1893); and 2,888 (1894).

U.S. Army in Report No. R-1885 entitled "Sequential Ignition in Small Arms Propellants by Means of Scheduling Coatings", by Ludwig Stiefel, Feb. 1968.

*Primary Examiner*—Harold J. Tudor
*Attorney, Agent, or Firm*—J. R. Wahl

[57] ABSTRACT

An ammunition cartridge comprises a tubular case having a head end and an open mount end, at least two propellant charges contained within said case, and a hermetic barrier means installed between the charges for separating the charges from one another and preventing premature crossflow of gases. One embodiment of the barrier means comprises a formed-in-place solid layer of polymeric resin material. This layer is formed in place on top of a first propellant charge, conforms to the surface contour of the first charge and extends radially across the charge to the tubular case.

Another preferred barrier means comprises a collapsible flexible polymeric disk extending radially across the case between the charges. This disk has a diameter at least equal to that of the inside of said case and a tubular outer rim operably engaged with said tubular case to provide a circumferential seal between the charges.

4 Claims, 4 Drawing Sheets

STRATIFIED PROPELLANT CHARGE BARRIERS FOR SMALL AND MEDIUM CALIBER AMMUNITION

BACKGROUND AND SUMMARY OF THE INVENTION

The present invention is generally related to cartridges having at least two stratified propellant charges and more particularly to a cartridge having a hermetic barrier or seal between these charges.

There have been many efforts over the years to reduce peak chamber pressures and improve ballistic performance of cartridges by providing stratified propellant charges in the cartridge case. Providing a spacer wad or diaphragm to maintain separation of the charges in these cases is also well known. Ammunition cartridges for small arms have been known to have perforated barriers between the propellant charges since the 1800's. These barriers helped to delay the ignition sequence and the pressure rise within the weapon chamber and therefore reduced recoil.

One such early cartridge is disclosed in U.S. Pat. No. 34,615 to A. Shannon in 1862. This cartridge had three black powder charges and two perforated diaphragms separating the charges from one another. The perforations permitted flame propagation between the charges and the size of the perforations determined the speed of such propagation from one charge to the other.

Another early cartridge, disclosed in U.S. Pat. No. 751,519, disclosed a metal, paper or felt diaphragm with a perforation therethrough to facilitate flame propagation and sequential charge ignition. The sequential charge ignition was designed to increase the velocity of the projectile without increasing the pressure in the gun.

An ordnance cartridge having separated charges is described in U.S. Pat. No. 1,920,075. This cartridge has a plurality of charges each separated from the other by an elastic lacquer spherical layer or a salt disk with a central bore therethrough through which the priming flame is directed to the forward most charge so as to ignite the forward charge first.

More recently, U.S. Pat. No. 2,072,671 issued to W. B. Foulke, disclosed a cartridge having a first loose propellent in the case and a second propellant encapsulated within cellulose capsules randomly positioned within the loose powder charge.

Another recent U.S. Pat. No. 4,593,622 to Fibranz, discloses a cartridge having a gas permeable barrier of a material such as felt or fabric between two propellants having different burn rates and a tube through the base charge and the barrier to cause the primer to ignite the top charge first. The gas permeable barrier separates the charges while permitting propagation of the flame front between the charges.

Each of the designs in these patents requires a direct communication path between the charges for the sequential ignition of the charges to properly occur. This direct communication between the charges is not believed to be necessary, and in fact may reduce the ignition delay and the pressure reducing effect of the sequential charge ignition.

A study of several non-communicative barriers was conducted and summarized for the US Army in Report No. R-1885 entitled "Sequential Ignition of Small Arms Propellants by Means of Scheduling Coatings", by Ludwig Stiefel. Various barriers were tested such as nitrocellulose sheet, cellulose acetate sheet, Saran film, rubber sheet, etc. These barriers were disks positioned in the case after the first propellant charge was installed. In addition, a bag made of a rubber glove finger was used to contain the second charge. These trials indicated, as did the above patents, that the peak pressure could be reduced.

However, all of these patents and the report just discussed, do not suggest utilizing a hermetic barrier between the charges to delay the ignition by maintaining charge separation until a preselected pressure is reached. We have found that a hermetic barrier placed between the charges is particularly advantageous in that it both delays and reduces the peak pressure experienced during propellant ignition or burning.

The present invention is particularly directed to cartridges having a reduced neck diameter such that a full diameter solid barrier would be difficult if not impractical to install. The cartridge of present invention comprises a tubular case having a conventional head end and a reduced diameter open mouth end, at least two propellant charges contained within said case, and a hermetic barrier means installed for separating the charges from one another and preventing premature crossflow of ignition gasses.

One preferred embodiment of the barrier means comprises a formed in place layer of polymeric resin material which conforms to the surface of a first charge loaded into a cartridge case. The self-leveling liquid resin must be viscous enough to stay primarily on the surface of the charge during the time it takes for the resin to cure into a solid layer.

An alternative is to use a very viscous fluid resin and then forcefully spread it over the charge surface.

If a less viscous liquid resin is used, a support disk must be used to prevent the resin from seeping into the propellant column. The layer may be formed by first installing a disk of kevlar fabric (could also use glass and other fabrics/fibers) or nitrocellulose against the first charge and then applying the liquid resin so as to coat the surface and edges of the disk to form the seal between the case wall and the charges. The resin must be fairly quick curing to form an impermeable barrier over the first charge without seeping through the first charge and prior to loading the next charge.

Another form of barrier in accordance with the invention is a flexible, elastically collapsible disk made of polyethylene or other flexible plastic material. The disk may be dish shaped or preferably may take the form of an umbrella which has a plurality of radial pleats to facilitate the collapse of the disk into a generally conical shape for insertion through the narrow case mouth. The elastically collapsed disk is inserted with the apex pointed toward the case mouth, i.e. the base end first. When the collapsed disk is fully inserted past the neck, it spreads to the inside diameter of the case. At this stage of insertion, the disk is still convex toward the mouth end. Upon seating the disk against the charge, the center of the disk is flexed and inverted so as to present a concave surface toward the case mouth and a convex surface toward the head end. The installed disk is thus placed in compression against the case to provide a flexible, resilient seal biased against the case to maintain the charge in position.

The disk may also have a tubular rim to provide a greater contact surface against the case wall when in the installed position. This rim presents a flat surface against the wall. The rim also can permit a tighter seal than simply the disk itself.

Another envisioned alternative preferred embodiment of the invention takes the form of a disk made of a shape memory material. The disk is formed into a curved shape below its transition temperature allowing it to be inserted through the core mouth. Following insertion, when the disk is heated above its transition temperature, it recovers to the flat disk shape. In this embodiment, the disk is slightly larger in diameter than the inner diameter of the cartridge case so that when the temperature exceeds the transition temperature, the disk will flatten out, pushing against the case wall, placing it in compression against the case wall.

DETAILED DESCRIPTION OF THE INVENTION

Figure 1A:
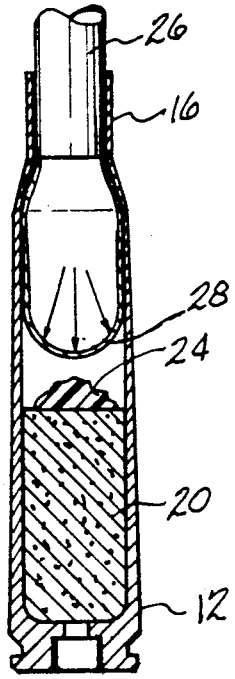
FIGS. 1*a*–1*c* are a longitudinal sectional view through a cartridge showing installation of a first embodiment of the propellant barrier of the invention.
Figure 1B:
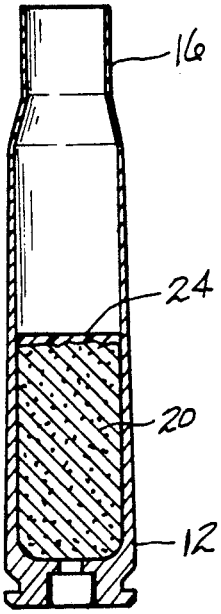
Figure 1C:
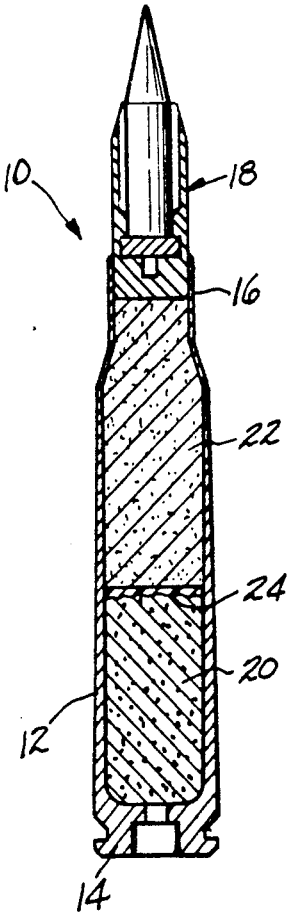

A cartridge 10 having a seal in accordance with the present invention installed therein is illustrated in section in FIG. 1 (*c*). Cartridge 10 comprises a cylindrical casing 12 having a head end 14 and a neck 16 having a reduced diameter receiving and holding therein a projectile assembly 18. A first propellant charge 20 and a second propellant charge 22, separated by a barrier layer 24 are contained within the casing 12 between the projectile assembly 18 and head 14.

Installation of the barrier layer 24 is illustrated schematically in FIGS. 1(*a*) and (*b*). A first propellant charge 20 is inserted in an empty casing 12. On top of this propellant charge 20 is placed a viscous layer of polymeric resin material which is self-leveling so as to form a level layer across the upper surface of the charge 20 as shown in FIG. 1(*b*). If the resin liquid is not self-leveling, the fluid resin may be forcefully spread over the charge by inserting into the neck 16 a tube 26 having a balloon type membrane 28 over the end thereof. As internal pressure is applied to the balloon 28, it expands, pressing and spreading layer 24 across the upper surface of the charge 20 in FIG. 1(*a*) to achieve a level surface as shown in FIG. 1(*b*). The layer 24 is then allowed to cure, hardening into a hermetic barrier prior to loading the second charge 22.

Figure 2A:
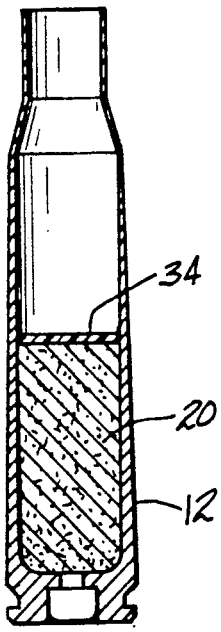
FIGS. 2*a*–2*c* are a longitudinal sectional view through a cartridge case having a second embodiment of the invention therein.
Figure 2B:
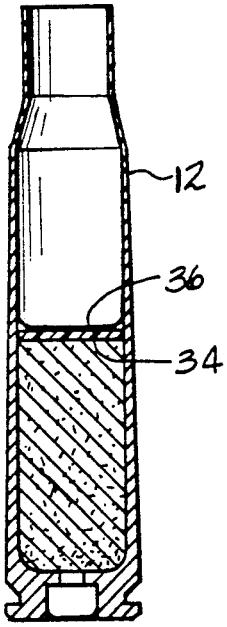
Figure 2C:
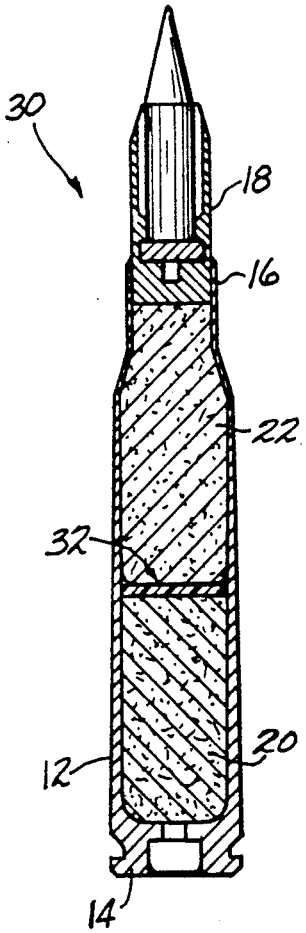

Like numbers corresponding to the embodiment illustrated in FIG. 1 will be utilized in the following description of alternative preferred embodiments of the invention as appropriate. A second preferred embodiment is illustrated in the views of FIG. 2. Once again, as shown in FIG. 2*c*, cartridge 30 comprises a casing 12 having a head 14 and a reduced diameter neck 16. Neck 16 receives and holds a projectile assembly 18. A first propellant charge 20 and a second propellant charge 22 separated by a barrier layer 32 is disposed within casing 12 in accordance with this embodiment of the invention. Barrier layer 32 is formed by first installing within casing 12 first propellant charge 20 and then placing thereon a paper or polyethylene disk 34. A thin sealing layer of thermoset plastic resin 36 is placed thereon to seal the edge between disk 34 and case 12. Once this layer has solidified, the second charge 22 and the projectile assembly 18 may be installed in a conventional manner. The presence of disk 34 is merely to prevent wicking of the resin layer 36 into the propellant charge 20. The disk 34 thus acts merely as a backing for the barrier layer 36. Barrier layer 36 provides a hermetic seal between charges 20 and 22.

Figure 4:
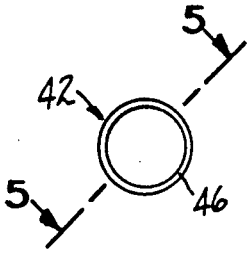
FIG. 4 is a separate end view of the seal shown in FIG. 3.
Figure 5:
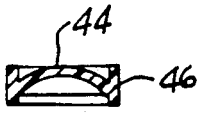
FIG. 5 is a cross-sectional view through the seal shown in FIG. 4.
Figure 3A:
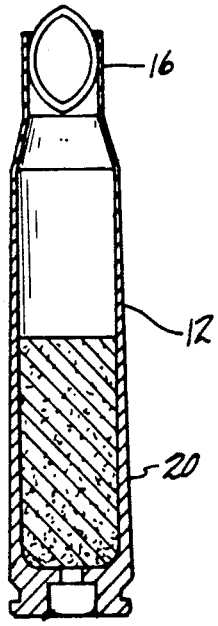
FIGS. 3*a*–3*c* are a longitudinal sectional view through cartridge having a third embodiment of the present invention therein.
Figure 3B:
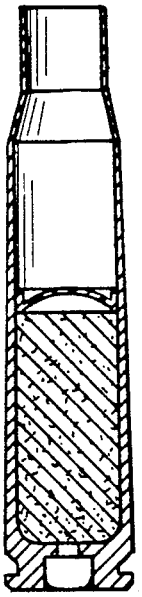
Figure 3C:
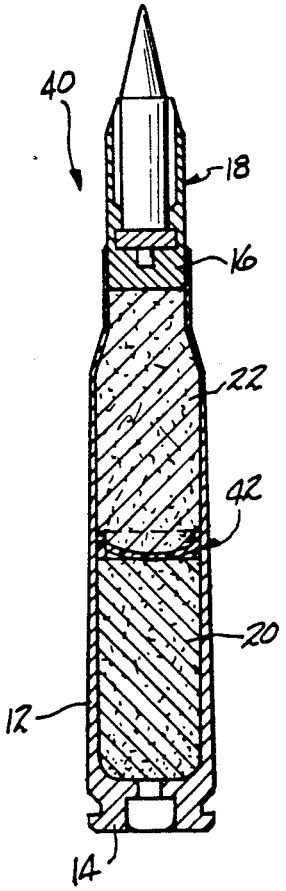

A third preferred embodiment of the barrier seal in accordance with the present invention is illustrated in FIGS. 3, 4, and 5. Once again, like numerals will be utilized where appropriate. In FIG. 3(*c*), a cartridge 40 including the barrier in accordance with this embodiment of the invention is shown in longitudinal sectional view. Cartridge 40 comprises case 12 having a head end and reduced diameter mouth or neck end 16 receiving and supporting a projectile assembly 18. Contained within casing 12 is a first propellant charge 20 and a second propellant charge 22 separated by a barrier seal 42 in accordance with this embodiment of the invention. As shown in FIGS. 4 and 5, barrier seal 42 is envisioned to be a bowed disk of high or low density polyethylene having a domed portion 44 and a tubular rim portion 46. The domed portion 42 is bistable and may be flexed between convex upward and convex downward position.

Opposite sides of the disk are squeezed together to deform the flexible barrier 42 and allow passage thereof through the narrowed neck 16 of the case 12 as shown in FIG. 3 (*a*). The barrier 42 is then rotated normal to the axis of case 12 and pressed against the first charge 20. The domed portion 44 of barrier 42 is then pressed downward to invert the domed portion so that is flexes outward causing the rim 46 to press against the sidewalls of case 12. The domed portion 44 thus rests against the upper surface of first propellant charge 20 as in FIG. 3(*c*). The domed portion 44 of barrier 42 will remain in the bistable position, convex downward, against charge 20, maintaining a force against the inside wall of case 12.

Figure 6A:
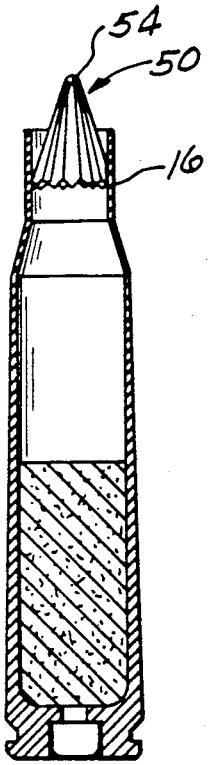
FIGS. 6*a*–6*c* are a longitudinal sectional view through a cartridge case having a fourth embodiment of the seal in accordance with the invention installed therein.
Figure 6B:
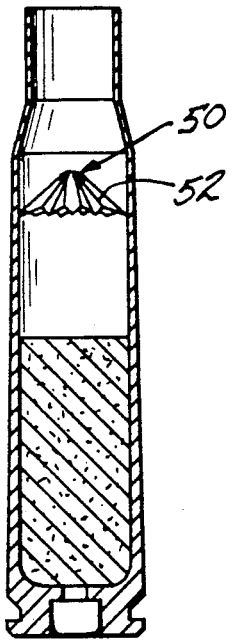
Figure 6C:
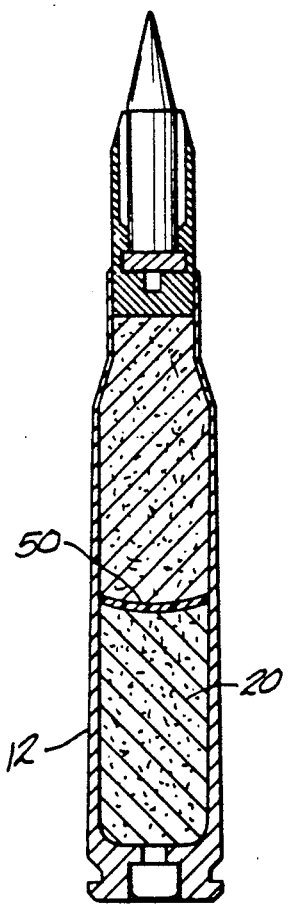

In a fourth embodiment of the present invention, illustrated in the views of FIG. 6, the barrier may be a flexible, pleated disk 50 having a plurality of equally spaced radial pleats 52 radiating from center 54. Barrier 42 may thus be compressed elastically into the shape of a shuttlecock as shown in FIGS. 6(*a*) and then inserted with the center 54 facing outwardly, into the casing neck 16. The outer perimeter of the barrier 50 expands to engage the inside wall of casing 12. See FIG. 6 (*b*). The center 54 is then pressed downward to expand the pleats 52 and thus seat the barrier 50 in an inverted concave upward position against the upper surface of charge 20. The outer diameter of barrier 50 is slightly greater than the inside diameter of casing 12 so that, once again, inversion of barrier 50 so that is rests convex downward against charge 20, places the barrier in compression against the inside wall surface of case 12. This compression maintains barrier 50 in position and effects the hermetic seal.

Each of the barrier embodiments described above separate the charges until a predetermined pressure is reached after ignition of charge 20. At that predetermined pressure, the barrier fails, allowing the burning propellant charge 20 to ignite the adjacent charge 22. The pressure at which barrier failure will occur should vary with the choice of barrier resin material and/or strength of the barrier disk utilized.

While the invention has been described above with reference to specific embodiments thereof, it is apparent that many changes, modifications and variations can be made without departing from the inventive concept disclosed herein. Accordingly, it is intended to embrace all such changes, modifications and variations that fall within the spirit and broad scope of the appended claims. All patent applications, patents and other publications cited herein are incorporated by reference in their entirety.

What is claimed is:

1. An ammunition cartridge comprising:

a tubular case having an inside surface, a head end and an open mouth end;

at least a first propellant charge loaded against said head end and a second propellant charge contained within said case; and a hermetic barrier means for separating said charges from one another and preventing premature cross-flow of gases, said barrier means comprising a formed-in-place solid layer of polymeric resin material over said first charge and extending transversely between said charges inside and tubular case and a support disk beneath said layer on top of said first charge, said layer sealing against the inside surface of said case.

2. An ammunition cartridge comprising:

a tubular case having an inside surface, a head end and an open mouth end, said mouth end being necked down to a neck diameter substantially less than that of said head end;

at least a first propellant charge loaded against said head end and a second propellant charge contained within said case; and a hermetic barrier means for separating said charges from one another and preventing premature cross-flow of gases, said barrier means comprising a formed-in-place solid layer of polymeric resin material over said first charge and extending transversely between said charges inside said tubular case and a support disk beneath said layer on top of said first charge, said layer sealing against the inside surface of said case.

3. The cartridge according to claim 2 wherein said disk is nitrocellulose.

4. The cartridge according to claim 2 wherein said layer is a thermoset plastic resin.

* * * * *